US006128833A

United States Patent [19]

Juppi et al.

[11] Patent Number: 6,128,833

[45] Date of Patent: Oct. 10, 2000

[54] DRYER-SECTION CONCEPT AND METHOD IN THE DRYING OF A PAPER/BOARD WEB

[75] Inventors: Kari Juppi, Keski-Palokka; Markku Karlsson, Parainen; Kari Edelmann, Palokka, all of Finland

[73] Assignee: Valmet Corporation, Helsinki, Finland

[21] Appl. No.: 08/945,224

[22] PCT Filed: Apr. 12, 1996

[86] PCT No.: PCT/FI96/00196

§ 371 Date: Oct. 10, 1997

§ 102(e) Date: Oct. 10, 1997

[87] PCT Pub. No.: WO96/32534

PCT Pub. Date: Oct. 17, 1996

[30] Foreign Application Priority Data

Apr. 12, 1995 [FI] Finland ..... 951746

[51] Int. Cl.[7] ..... F26B 3/00

[52] U.S. Cl. ..... 34/464; 34/402; 162/206

[58] Field of Search ..... 34/402, 419, 422, 34/444, 445, 446, 463, 464, 549, 551, 111, 113, 114, 116, 117, 120, 122, 123; 162/206, 207

[56] References Cited

U.S. PATENT DOCUMENTS

| | | | |
|---|---|---|---|
| 3,089,252 | 5/1963 | Daane et al. | 34/114 |
| 4,183,148 | 1/1980 | Koski et al. | 34/454 |
| 5,586,397 | 12/1996 | Kerttula et al. | 34/114 |
| 5,862,613 | 1/1999 | Kerttula et al. | 34/446 |

FOREIGN PATENT DOCUMENTS

| | | |
|---|---|---|
| 0427217 | 5/1991 | European Pat. Off. . |
| 0427218 | 5/1991 | European Pat. Off. . |
| 0655528 | 5/1995 | European Pat. Off. . |
| 56040 | 8/1993 | Japan . |

*Primary Examiner*—Pamela A. Wilson
*Attorney, Agent, or Firm*—Steinberg, Raskin & Liberchuk, P.C.

[57] ABSTRACT

The invention concerns a dryer-section concept of a paper/board machine and a method in the drying of a paper/board web (W). The dryer section comprises a number of drying cylinder groups ($R_I$ . . . $R_N$), which comprise a single-wire draw, on whose support the web (W) is guided so that it meanders as loop-shaped from a drying cylinder onto a suction cylinder. The web (W)/the wire (H) is guided so that the web is placed against the face of the drying cylinder and the wire is placed outside. In the dryer-section concept, the web (W) is passed from one drying cylinder group ($R_I$) into the next dryer group ($R_{II}$) and further. According to the invention, at least some of the drying cylinders ($K'_1$, $K'_2$, $K'_3$) include impingement units (100, 101, 102) or equivalent in connection with them, through which units a heated medium, preferably air or steam, is passed through the wire into connection with the web (W) so as to produce a two-sided drying effect and to increase the drying capacity.

20 Claims, 6 Drawing Sheets

DRYER-SECTION CONCEPT AND METHOD IN THE DRYING OF A PAPER/BOARD WEB

FIELD OF THE INVENTION

The invention concerns a dryer-section concept and a method in the drying of a paper/board web.

The invention concerns a dryer section of a novel type for a paper machine, by means of which dryer section it is possible to enhance the drying and to improve the control of curling without deterioration of the runnability of the dryer section and of the efficiency of the paper machine.

BACKGROUND OF THE INVENTION

In the prior-art dryer-section concepts based on single-wire draw, in view of prevention of curling of paper, it is necessary to invert at least one group, in which case the paper is also dried from the other side. It has been noticed that, in the event of a web break, such so-called inverted groups with single-wire draw are difficult to clean, and the fibre strings produced may break wires and blow boxes and produce unnecessary losses in production.

The system of the present sort can be abandoned by using a drying geometry in which the dryer section consists of drying cylinders and of impingement units fitted on said cylinders, out of which impingement units hot air/steam is blown through the wire onto the paper. By means of such an impingement unit, a considerable increase in the evaporation capacity is achieved. In such a case, the evaporation takes place increasingly from the wire side on the cylinder. Owing to the increased evaporation capacity, the dryer section can be made shorter, thus obtaining economies in the cost of construction of the hall. Owing to the increased evaporation capacity, the concept of the invention can also be applied to modernizations, in which the available space is often quite limited.

From the application JP 222,691/1993, a dryer section is known in which there is an impingement hood placed on the top of all of the upper cylinders. In the present invention of ours, the impingement hoods are preferably placed in connection with the cylinders only at which the hoods provide a considerable effect either on the control of curling or on an increased drying capacity.

When the impingement is carried out through the wire, the paper is protected between the wire and the cylinder and it has no possibility to form so-called agglomerations, which might collide with the impingement device itself and damage it.

An increase in the evaporation on the cylinder normally results in a lower average temperature of the web and thereby slightly reduces the evaporation taking place in the area of free draw, but, on the other hand, the delivery of heat by the cylinder is increased, which increases the overall evaporation.

The impingement unit can also be divided into blocks in the direction of width of the machine, in which case, by means of the unit, it is possible to act upon the evenness of the moisture profile in an attempt to improve the uniformity of the final product in the cross direction of the web.

SUMMARY OF THE INVENTION

The dryer-section concept in accordance with the invention is mainly characterized in that the dryer section comprises a plurality of drying cylinder groups including one or more single wire draw drying groups having suction cylinders, heated drying cylinders, a drying wire on which a web is carried and guide means for guiding the drying wire while the web is carried thereon between the suction cylinders and drying cylinders. The drying wire is guided from one suction cylinder onto a drying cylinder, from that drying cylinder onto another suction cylinder and from this suction cylinder to another drying cylinder and such that the web is interposed between a face of each drying cylinders and the drying wire while the web runs over the drying cylinders and the drying wire is interposed between the web and the suction cylinders while the web runs over the suction cylinders. Impingement units are provided, each arranged in opposed relationship to a respective drying cylinder and including means for directing a heated medium through the drying wire at the web, since the web is interposed between the drying wire and the face of the drying cylinder when running over the drying cylinders, to produce a two-sided drying effect about the respective drying cylinder. The respective drying cylinder is one of only those drying cylinders in the single wire draw drying group which enables the impingement unit arranged in opposed relationship thereto to effect an increase the drying capacity of the single wire draw drying group.

The method in accordance with the invention in the drying of a paper/board web is mainly characterized in drying cylinders in the single wire draw drying group(s) are selected which when associated with an impingement unit, enable the impingement unit to effect an increase the drying capacity of that single wire draw drying group, impingement units are arranged in opposed relationship to a respective one of at least some of the selected drying cylinders in that single wire draw drying group, and a drying medium is directed from the impingement units through the drying wire at the web running over the respective selected drying cylinder.

BRIEF DESCRIPTION OF DRAWINGS

The invention will be described in the following with reference to some preferred embodiments of the invention illustrated in the figures in the accompanying drawing, the invention being, yet, not supposed to be confined to said embodiments alone.

DETAILED DESCRIPTION OF PREFERRED EMBODIMENTS

Figure 1:
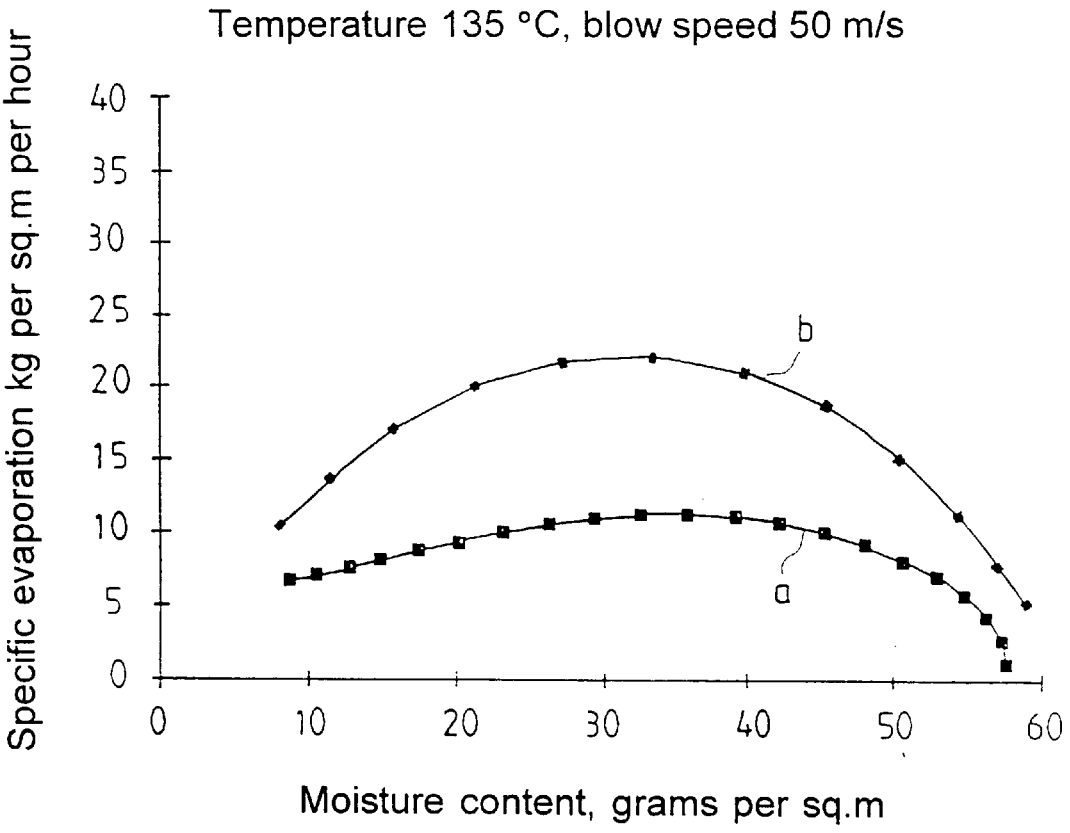
FIG. 1 illustrates specific evaporation when impingement blowing is used with different wires as a function of the moisture content of the paper.

FIG. 1 shows an example of the specific evaporation produced by the blowing taking place through the wire as a function of the moisture content of the web with wires of different permeabilities. The graph a represents a wire whose permeability is 1500 cubic meters per square meter in an hour ($m^3/m^2/h$), and a graph b represents a wire of higher permeability, whose permeability is 4500 $m^3/m^2/h$. It is noticed that the impingement blowing is more efficient when the drying wire is more open. By means of bowing through the wire, it is possible to achieve a considerable increase in the evaporation capacity compared with conventional cylinder drying. In the case of FIG. 1, the increase is 30 . . . 80%, depending on the openness of the wire. The efficiency of the blowing through the wire, of course, also depends, e.g., on the medium that is blown, on its temperature, moisture content, and on the blow speed.

If it is desirable to affect the curling of paper only, impingement units may be installed in the final end of the dryer section only. In such a case, evaporation takes place from both faces, and curling is reduced or can be prevented entirely.

If it is desirable to affect the drying capacity alone in order to increase said capacity, impingement units are placed exclusively in the area in the dryer section in which the dry solids content of the web is in the range of from about 55% to about 85%.

Figure 2:
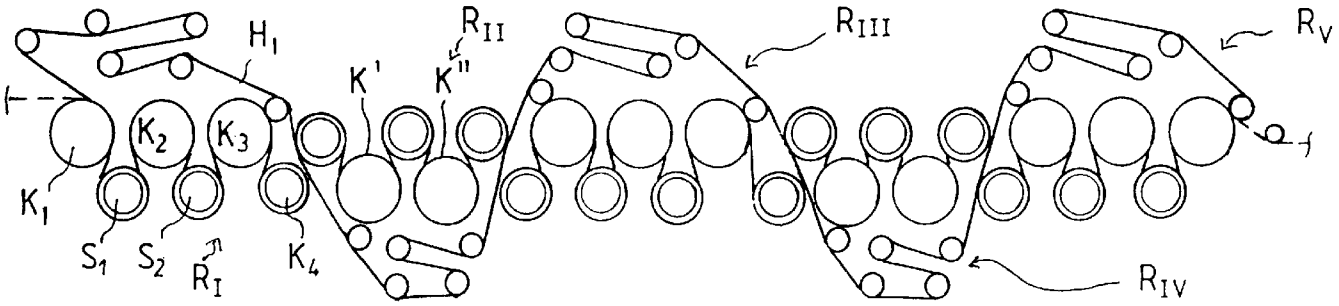
FIG. 2 shows a prior-art dryer-section concept, which comprises so-called inverted groups, in which both ordinary groups with single-wire draw and upper felt and so-called inverted groups with single-wire draw and lower felt are employed.

FIG. 2 shows a conventional dryer-section concept, which comprises six dryer groups, i.e. the groups $R_I$ . . . $R_V$. Each dryer group is provided with single-wire draw. In the group $R_I$, the wire is guided over the upper guide rolls onto the first drying cylinder $K_1$ in the group, placed below said guide rolls, and from said cylinder onto the lower suction roll/suction cylinder $S_1$, and from the suction roll/cylinder $S_1$ back onto the upper drying cylinder $K_2$ and further, while proceeding in meander form, forwards in the group. The lower suction rolls/cylinders are preferably suction rolls/cylinders of the Vac-Roll type, into whose interior a vacuum is passed, being applied to the entire inner face of the roll and through perforations in the roll to the grooves or equivalent recesses placed on the roll face. In such a case, the vacuum is distributed evenly through the wire and applied to the web W passed outside the wire, a holding force being applied to the web. In this way, the web W is held in contact with the wire also on the runs of the web at which the web W is placed outside and the wire $H_1$ is placed between the web W and the roll face. In the group $R_I$, the drying cylinders are preferably steam-heated drying cylinders. They are placed in the group $R_I$ above the suction rolls. In the group $R_{II}$ the drying side is changed, and the other side of the web W is also passed into direct contact with the drying-cylinder face K', K" . . . The group $R_{III}$ is again an ordinary group with single-wire draw, in which the web runs in contact with the upper drying cylinders, and thus the drying side of the web W has again been changed, i.e. the side of the web is placed in direct contact with the face of a drying cylinder that was in contact with a drying cylinder in the group $R_I$. The group $R_{IV}$ is again an inverted group, in which the drying side is changed. Thus, when proceeding from one group to the other, the drying side of the web W, i.e. the side that is placed against the drying cylinder, is changed.

The drying cylinders $K'_1$ . . . $K'_3$ described above may comprise smooth-faced steam heated drying cylinders. As shown in the figures, each impingement unit 100, 101 and 102 each includes a discharge face from which the heating medium is directed at the web while the web runs over a sector of the opposed one of the drying cylinders. Further, each impingement unit 100, 101 and 102 is arranged such that the discharge face of the respective impingement unit is at a small distance from the face of a respective drying cylinder. The impingement units as described herein may be arranged, if desired, in the only the final half of the dryer section by length for the purpose of controlling curling.

Figure 3:
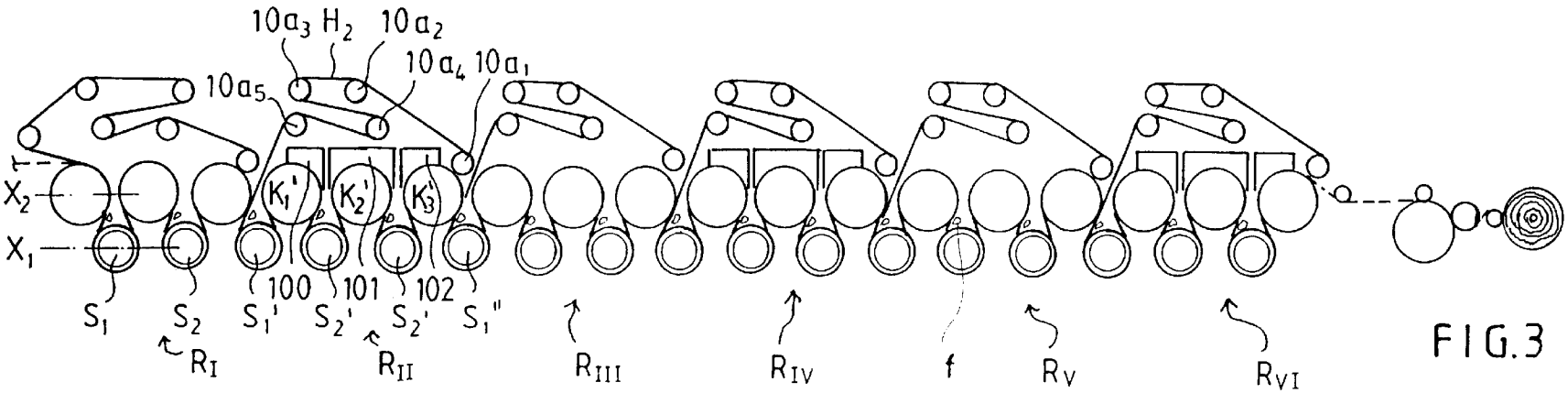
FIG. 3 shows a dryer-section concept in accordance with the present invention, in which the inverted groups have been substituted for by groups provided with impingement units, in which groups the run of the wire/web is in the other respects similar to that in an ordinary group except that the drying cylinders are provided with impingement units.

FIG. 3 shows a preferred dryer-section concept in accordance with the invention, in which there are six groups of drying cylinders, i.e. the groups $R_I$ . . . $R_{VI}$. In the concept shown in the figure, every other group is a group of drying cylinders provided with an impingement unit. In FIG. 3, the group $R_{II}$ is shown, in which there is a wire draw $H_2$ and in which the wire is passed over the guide rolls $\mathbf{10}a_1$, $\mathbf{10}a_2$, $\mathbf{10}a_3$, $\mathbf{10}a_4$, $\mathbf{10}a_5$ onto the first suction roll $S_1$, which is placed in the lower plane $X_1$, and from said Vac-Roll onto the heated drying cylinder $K_1'$, which is placed in the upper horizontal plane $X_2$ and on which there is an impingement unit, through which drying medium, preferably heated air or superheated steam, is passed through the wire onto the web W.

In FIG. 3, in the group $R_{II}$, an impingement unit 100 is placed on the drying cylinder $K'_1$ above the first drying cylinder $K'_1$. The wire and the web run in the group $R_{II}$ onto the lower suction roll $S'_2$ and from the suction roll back onto the drying cylinder $K_2$, which is placed in the plane $X_2$ and which includes an impingement unit 101 placed on a sector of 180°. Then, drying medium is passed on a sector of 180° into connection with the web W.

From the drying cylinder $K'_2$ in the group $R_{II}$ of drying cylinders, the web and the wire are passed along a loop-like meandering path onto the suction roll $S'_2$ and from the suction roll $S'_2$ again onto the heated drying cylinder $K'_3$ placed in the plane $X_2$ and including an impingement unit 102 placed on an inlet sector of 90°. Thus, as is shown in FIG. 3, all the drying cylinders $K'_1$ . . . $K'_3$ in the group $R_{II}$ comprise impingement units, of which the first drying cylinder $K'_1$ comprises impingement devices on an outlet sector of 90°, which are fitted on the latter half of the covering area of the whole drying cylinder, covering about 90°. At the middle drying cylinder $K'_2$, the impingement unit is placed over almost the entire covering area, i.e. on a sector of about 180°, and on the last drying cylinder $K'_3$ there is an impingement unit on an inlet sector of 90°.

In other words, the first impingement unit is arranged such that a discharge face of the first impingement unit is in opposed relationship to a 90° outlet sector of the first drying cylinder $K'_1$, the second impingement unit is in opposed relationship to a 180° sector of the second drying cylinder $K'_2$, which is substantially the entire circumferential sector of the second drying cylinder about which the web runs, and the third impingement unit is arranged such that the discharge face of the third impingement unit is in opposed relationship to a 90° inlet sector of the third drying cylinder $K'_3$.

The web W is passed from the drying cylinder $K'_3$ into the next group $R_{III}$ onto its first suction cylinder (Vac-Roll) $S_1$" and over said Vac-Roll onto the drying cylinder $K_1$"' placed in the plane $X_2$ and further in the conventional way in the group $R_{III}$ with single-wire draw. The group $R_{III}$ does not include impingement units. The next group $R_{IV}$ again comprises impingement units in accordance with the invention, in a way similar to the group $R_{II}$. Thus, in connection with the transfer from one group to the other, an inverted group and drying from the other side have been substituted for by impingement drying.

In a dryer section as shown in FIG. 3, it is also possible to employ prior-art blow or suction boxes (f), for example blow boxes marketed by the applicant with the product name UNO-RUN BLOW BOX, to guarantee undisturbed running of the web along with the wire from a cylinder onto a lower roll.

Figure 4A:
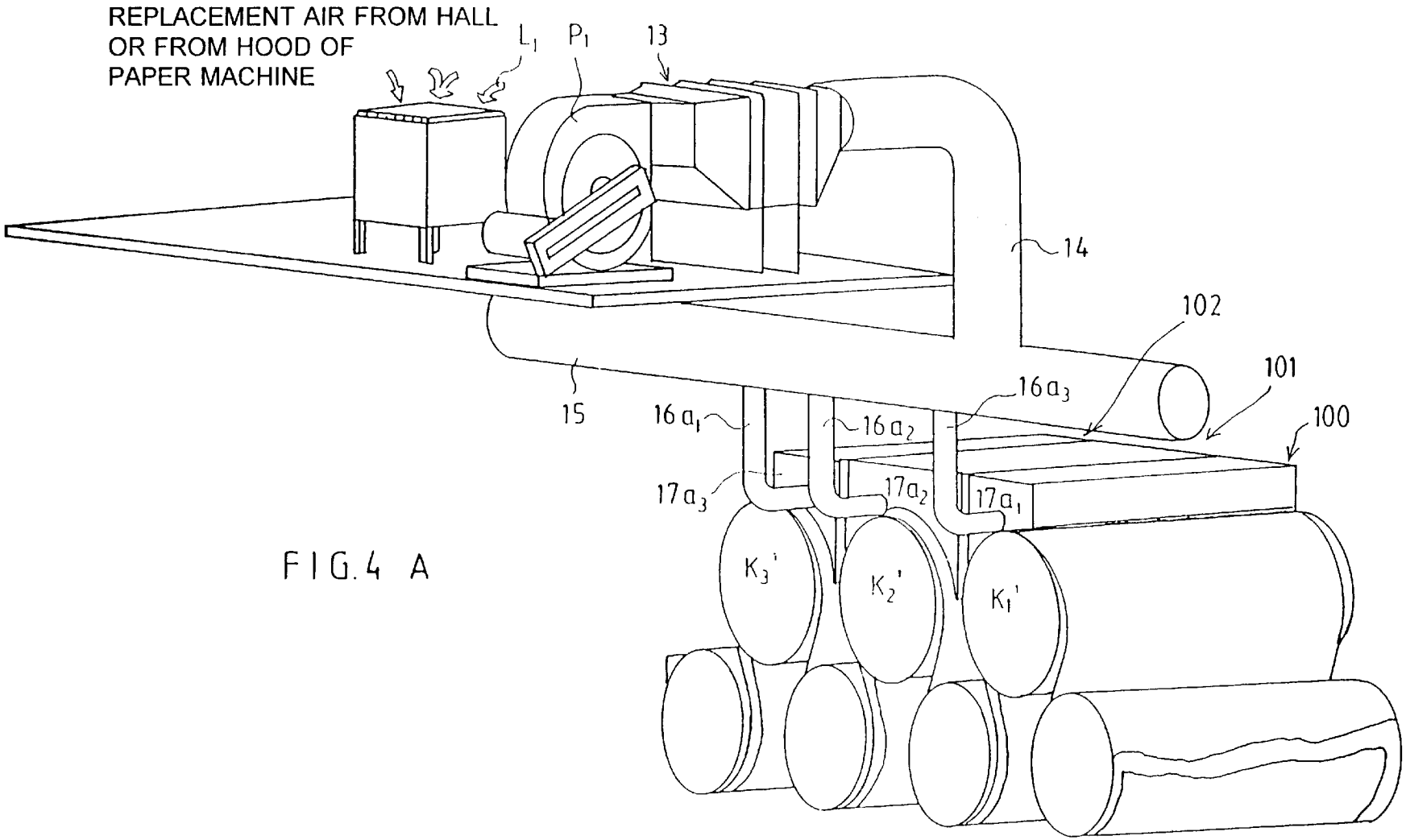
FIG. 4A is an axonometric separate illustration of an impingement group in accordance with the invention.

FIG. 4A illustrates the supply of heating medium into the group $R_H$ shown in FIG. 3. Out of the pipe 15, the hot heating medium is passed through the branch ducts 16$a_1$, 16$a_2$ and 16$a_3$ into the boxes or hoods 17$a_1$, 17$a_2$ and 17$a_3$ of the impingement units 100, 101, 102, which boxes or hoods extend across the width of the cylinders. Through the boxes the heating medium is distributed uniformly into connection with the wire and through the wire into connection with the web W, which is placed against the heated drying cylinder $K_1'$, $K_2'$, $K_3'$. In the embodiment of FIG. 4A, the drying medium, such as superheated steam or heated air, is passed into the boxes 17$a_1$, 17$a_2$ . . . and further through their heating-medium discharge faces into connection with the wire H and through the wire onto the web W. In the embodiment of FIG. 4A, there is no separate steam exhaust duct, but the heating medium that has passed to outside the hood is transferred from the interior of the hood of the paper machine to outside the hood along with the air discharge circulation.

In the embodiment of FIG. 4A, the air is taken from the paper machine hall or from the hood of the paper machine in the way indicated by the arrow $L_1$ and is passed by means of a centrifugal blower $P_1$ into a heating unit 13, which may be a heat-exchanger construction, in which air is heated, for example, by means of steam or by means of a separate burner. The heated air is transferred further 14, in the way shown in the figure, into the pipe 15 and from it into the branch ducts 16$a_1$, 16$a_2$ . . . and further into the impingement units 100, 101, 102 . . .

Figure 4B:
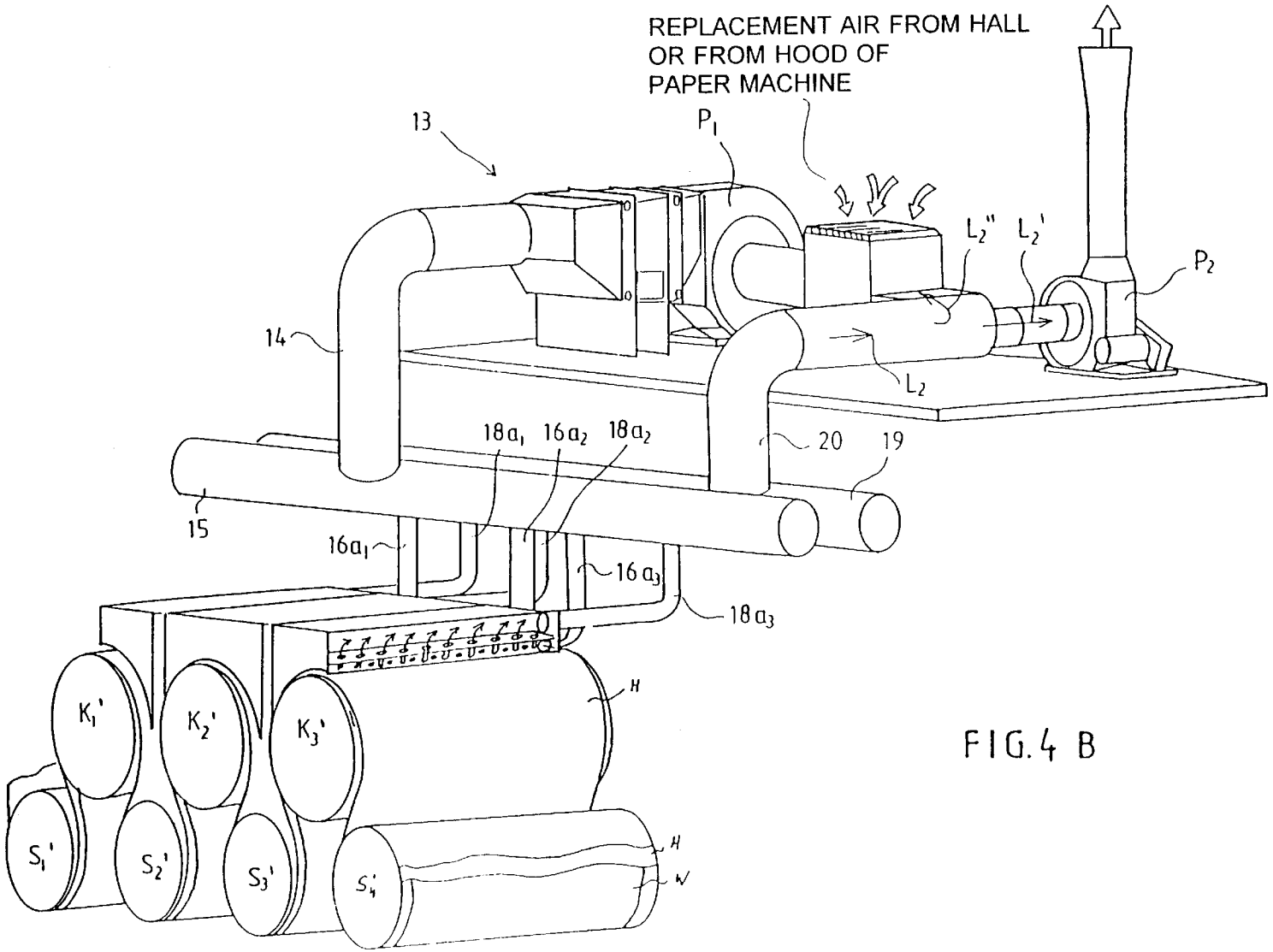
FIG. 4B shows a second embodiment of the transfers of the heating medium.

FIG. 4B shows an embodiment of the invention which is in the other respects similar to FIG. 4A, but in the solution of FIG. 4B the removal of the heating medium from the interior of the unit 100, 101 . . . has also been arranged. As is shown in FIG. 4B, heating medium is removed from the interior of each unit through the ducts 18$a_1$, 18$a_2$, 18$a_3$ into the collector duct 19 and from it further into the duct 20 in the way indicated by the arrow $L_2$. Exhaust air or steam can be recirculated in the way indicated by the arrow $L_2$" through the blower $P_1$ into the duct 14, or said exhaust flow from the duct 20 can be passed directly by means of the circulation produced by the blower $P_2$ out of the equipment.

Figure 4C:
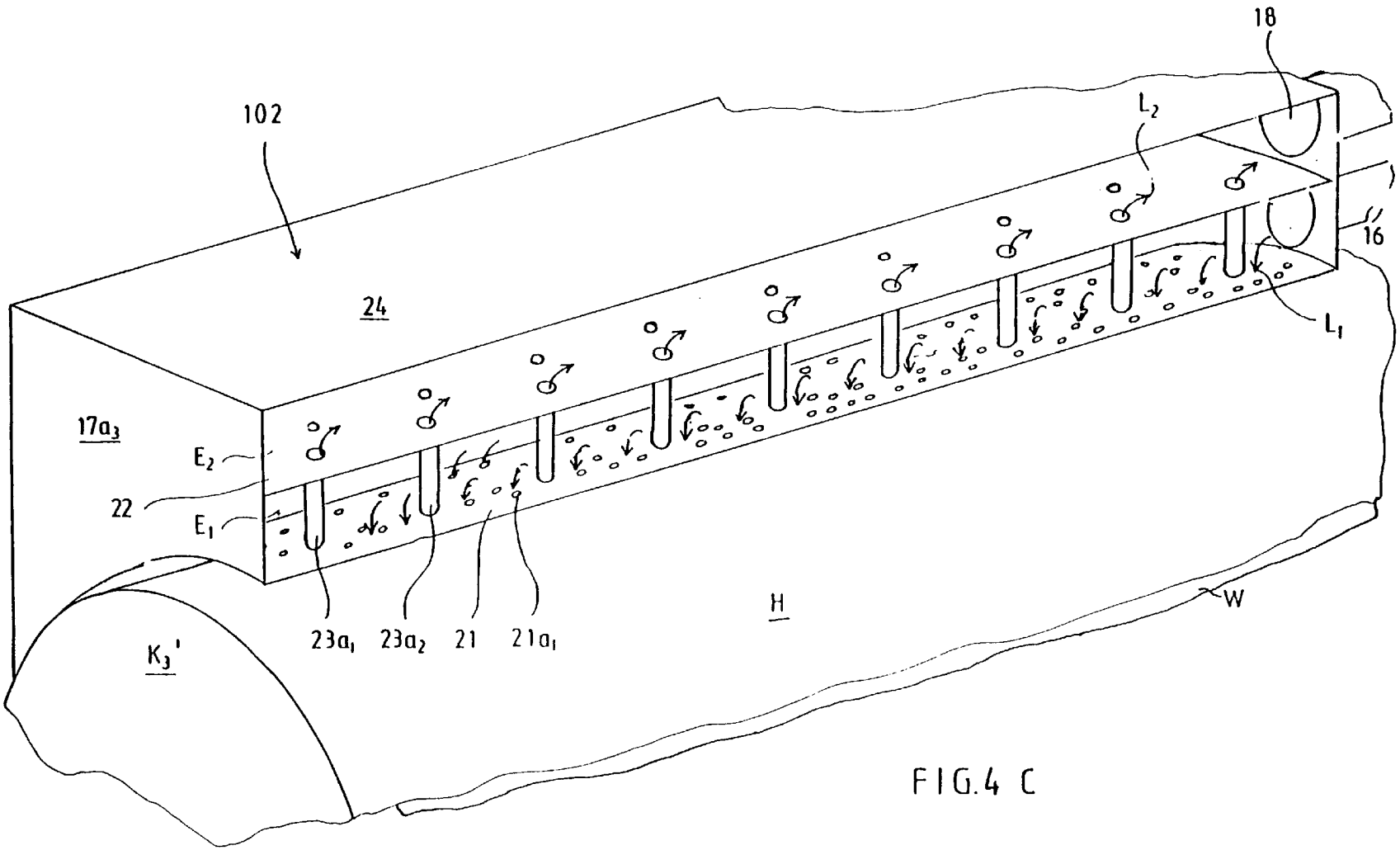
FIG. 4C is a detailed illustration of the construction shown in FIG. 4B.

FIG. 4C is a sectional view of the construction of the impingement unit 102. The duct 16 is connected with the blow section $E_1$, which is placed below the box 17$a_2$ and which is defined by the heating-medium discharge face 21 and by the upper plate construction 22 as well as by the side walls of the box 17$a_2$. Between the intermediate plate 22 and the top plate 24 of the box 17$a_2$ placed above, the exhaust chamber $E_2$ is defined, into which the heating medium is recirculated from the wire H through the pipes 23$a_1$, 23$a_2$, 23$a_3$. The pipes 23$a_1$, 23$a_2$ . . . are opened both from the discharge face 21 and from the intermediate plate 22. Further, the discharge face 21 includes perforations 21$a_1$, 21$a_2$, through which the heated heating medium passed into the space $E_1$ is made to flow further into connection with the wire H. From the space $E_2$, the heating medium, such as air or steam, is passed into the duct 18 and further out of the unit 102.

Figure 5:
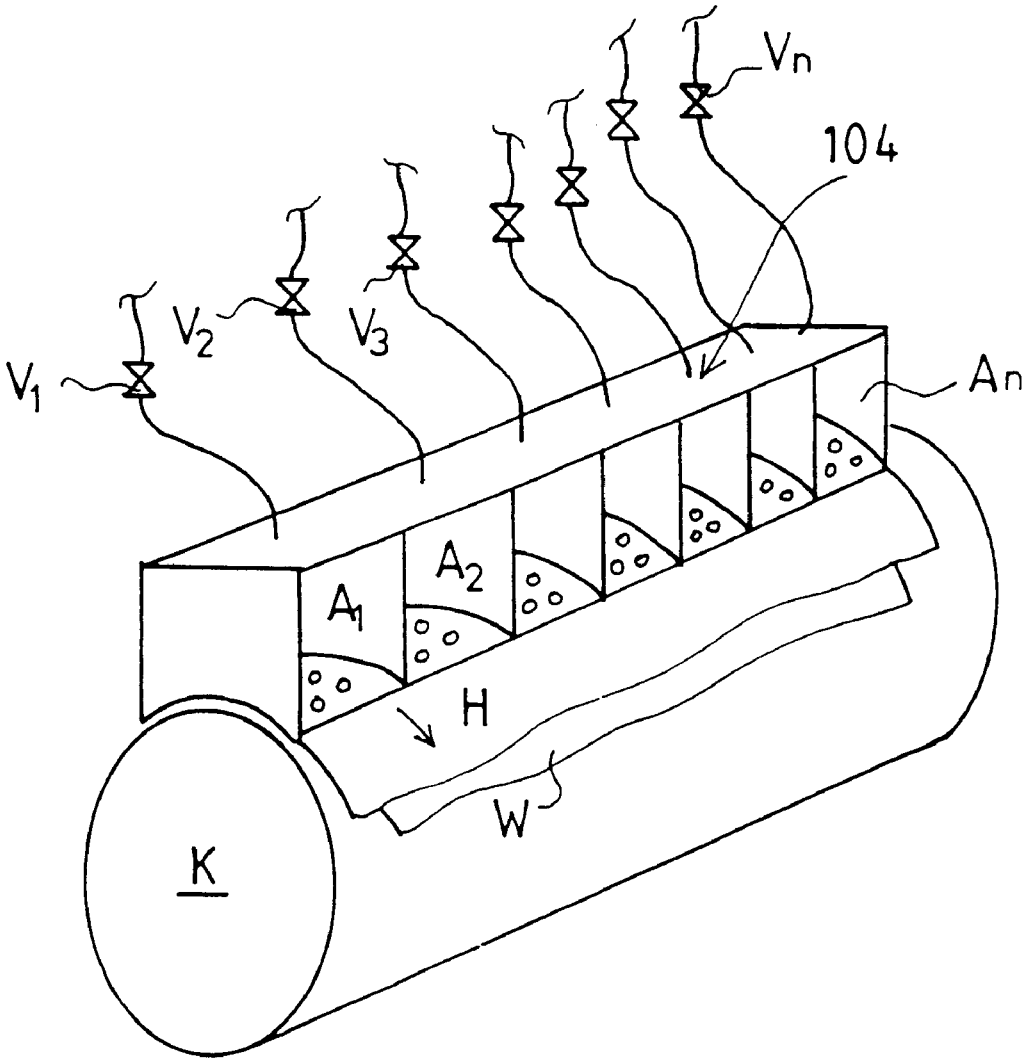
FIG. 5 shows an embodiment of the invention in which the impingement box has been divided into blocks across the width of the box. By means of the arrangement, it is possible to control the moisture profile of the web across the web width.

FIG. 5 shows an embodiment of the invention in which the impingement unit 104 is provided with separate blocks $A_1$, $A_2$ . . . $A_n$ fitted in the direction of width of the web W. For the purpose of illustrating the blocks $A_1$, $A_2$ . . . , the front plate of the blow box 104 has been removed in FIG. 5. Heating medium can be supplied independently into each block, and in this way it is possible to regulate the moisture profile of the web, i.e. the evaporation of moisture from the web, across the width of the web. Within the scope of the invention, an embodiment is possible in which the supply of the drying medium in the blocks $A_1$, $A_2$ . . . into connection with the web is regulated by means of separate regulation means, which are placed, for example, in direct vicinity of the heating-medium discharge face. The supply of heating medium into each block can, however, also be regulated in some other way, for example by means of a separate valve $V_1$, $V_2$ . . . $V_n$ placed in the line passing into the block. The regulation of the moisture profile of the web can also be carried out by, into the different blocks, passing a medium of different temperature or humidity.

What is claimed is:

1. In a dryer section of one of a paper and board machine comprising a plurality of drying groups through which a web is passed, said plurality of drying groups including at least one single wire draw drying group, said at least one single wire draw drying group including suction cylinders, heated drying cylinders, a drying wire on which the web is carried and guide means for guiding said drying wire while the web is carried thereon between said suction cylinders and said drying cylinders, the drying wire being guided from one of said suction cylinders to one of said drying cylinders, from said one of said drying cylinders to another one of said suction cylinders and from said another suction cylinder to another one of said drying cylinders and such that the web is interposed between a face of each of said drying cylinders and said drying wire while running over said drying cylinder and said drying wire is interposed between the web and said suction cylinders while running over said suction cylinders, the improvement comprising:

impingement units each arranged in opposed relationship to a respective one of said drying cylinders and including means for directing a heated medium through said drying wire at the web to produce a two-sided drying effect about said respective drying cylinder to prevent the curling of the web, said drying wire having an air permeability value higher than 1500 $m^3/m^2$/hour;

said respective drying cylinder being one of said drying cylinders in said at least one single wire draw drying group which enables said impingement unit arranged in opposed relationship thereto to effect an increase in the drying capacity of said at least one single wire draw drying group.

2. The dryer section of claim 1, wherein said at least one single wire draw drying group comprise a plurality of single wire draw drying groups, said impingement units being arranged only in a portion of said plurality of single wire draw drying groups such that at least one of said plurality of single wire draw drying groups does not include an impingement unit.

3. The dryer section of claim 1, wherein said respective drying cylinder is a selected one of said drying cylinders in said at least one single wire draw drying group which enables said impingement unit arranged in opposed relationship thereto to control curling of the web, said impingement units being arranged in an area of a final half of the dryer section by length.

4. The dryer section of claim 1, wherein said impingement units are arranged only an area of the dryer section in which the dry solids content of the web is in a range of about 55% to about 85%.

5. The dryer section of claim 1, wherein said drying cylinders in said at least single wire draw drying group are smooth-faced steam-heated drying cylinders, said impingement units each having a discharge face from which the heated medium is directed at the web while the web runs over a sector of the opposed one of said drying cylinders, each of said impingement units being arranged relative to the respective one of said drying cylinders such that said discharge face is at a small distance from the face of said respective drying cylinder.

6. The dryer section of claim 5, wherein said impingement units comprises a first impingement unit, a second impingement unit and a third impingement unit, said first impingement unit being arranged such that said discharge face of said first impingement unit is in opposed relationship to a 90° outlet sector of a first one of said drying cylinders, said second impingement unit being arranged such that said discharge face of said second impingement unit is in opposed relationship to a 180° sector of a second one of said drying cylinders, which is substantially the entire circumferential sector of said second drying cylinder about which the web runs, said third impingement unit being arranged such that said discharge face of said third impingement unit is in opposed relationship to a 90° inlet sector of a third one of said drying cylinders.

7. The dryer section of claim 1, wherein the heated medium is heated air.

8. The dryer section of claim 1, wherein the heated medium is steam.

9. The dryer section of claim 1, wherein said respective drying cylinder is also one of only those of said drying cylinders in said at least one single wire draw drying group which enables said impingement unit arranged in opposed relationship thereto to affect and prevent curling of the web, said impingement units being arranged at an end of the dryer section to direct the heated medium at the web while the web has a dry solids content in a range which enables affecting and prevention of curling of the web.

10. The dryer section of claim 1, wherein at least one of said impingement units comprises a plurality of separated blocks across its width, a separate flow of the heated medium being passed into each of said blocks and directed therefrom at the web, the quantity and properties of the heated medium in the flows passing into said blocks being independently adjustable to thereby enable regulation of a moisture profile of the web across the width of the web.

11. The dryer section of claim 1, wherein at least one of said impingement units comprises an intake chamber for receiving the heated medium, a discharge face arranged in opposed relationship to said respective drying cylinder, the heated medium being directed from said intake chamber at the web through said discharge face, an exhaust chamber for receiving exhaust air and/or stream from the vicinity of the web, and pipes arranged between said discharge face and said exhaust chamber for passing the exhaust air and/or steam from the vicinity of the web to said exhaust chamber.

12. The dryer section of claim 11, wherein said cylinder groups are arranged in a hood, further comprising heating means for heating air taken from outside said hood, and blow means for receiving the heated air from said heating means and directing the heated air into said impingement units such that the heated air constitutes the heated medium.

13. In a method for drying one of a paper and board web in a dryer section which comprises a plurality of drying groups through which the web is passed, said plurality of drying groups including at least one single wire draw drying groups, said at least one single wire draw drying group having suction cylinders, heated drying cylinders, a drying wire on which the web is carried and guide means for guiding said drying wire while the web is carried thereon between said suction cylinders and said drying cylinders such that the web is interposed between a face of each of said drying cylinders and said drying wire while running over said drying cylinder and said drying wire is interposed between the web and said suction cylinders while running over said suction cylinders, the improvement comprising the steps of:

selecting a drying wire having an air permeability value higher than 1500 $m^3/m^2$/hour;

selecting drying cylinders in said at least one single wire draw drying group which when associated with an impingement unit, enable the impingement unit to effect an increase the drying capacity of said at least one single wire draw drying group, arranging impingement units in opposed relationship to a respective one of at least one of said selected drying cylinders in said at least one single wire draw drying group, and directing a drying medium from said impingement units through said drying wire at the web running over said respective selected drying cylinder.

14. The method of claim 13, further comprising the step of:

directing the drying medium from said impingement units through a respective discharge face positioned substantially parallel to at least portion of said respective selected drying cylinder over which the web runs.

15. The method of claim 14, further comprising the step of:

arranging the discharge face of at least one of said impingement units in opposed, substantially parallel relationship to a 90° outlet sector of said respective selected drying cylinder.

16. The method of claim 14, further comprising the step of:

arranging the discharge face of at least one of said impingement units in opposed, substantially parallel relationship to a 90° inlet sector of said respective selected drying cylinder.

17. The method of claim 13, further comprising the step of directing the drying medium at the web from at least one of said impingement units over substantially the entire circumferential sector of said respective selected drying cylinder on which the web is in contact with said respective selected drying cylinder.

18. The method of claim 13, further comprising the step of:

regulating the moisture profile of the web across the width of the web by varying the properties of the drying medium being directed at the web across the width of the web, said moisture profile regulating step comprising the steps of partitioning at least one of said impingement units into separated blocks across its width, directing a separate flow of the drying medium into each of said blocks, and independently regulating the quantity and properties of the flow of the drying medium into each of said blocks.

19. The method of claim 18, wherein the step of independently regulating the quantity and properties of the flow of the drying medium into each of said blocks comprises the step of arranging valves through which a respective flow of the drying medium passes before entering into each of said blocks.

20. The method of claim 13, further comprising the steps of:

arranging separate intake and exhaust chambers in said impingement units, directing the drying medium from said intake chamber at the web, and drawing exhaust steam from the vicinity of the web into said exhaust chamber through pipes extending through said intake chamber.

* * * * *